US006061913A

United States Patent [19]

Grieshaber et al.

[11] Patent Number: 6,061,913

[45] Date of Patent: May 16, 2000

[54] PLASTIC FILLER SPATULA/PLANE

[75] Inventors: Klaus Grieshaber, Maintal; Willy Böllinghaus, Frankfurt; Otto Haller, Rodgau, all of Germany

[73] Assignee: Heinrich Konig & Co. KG, Germany

[21] Appl. No.: 09/111,093

[22] Filed: Jul. 6, 1998

[30] Foreign Application Priority Data

Jul. 12, 1997 [DE] Germany ..... 197 36 985

[51] Int. Cl.[7] ..... B05C 17/10

[52] U.S. Cl. ..... 30/169; 15/245.1; 15/236.01

[58] Field of Search ..... 15/245.1, 236.01; 294/7; 30/169; 428/34.1

[56] References Cited

U.S. PATENT DOCUMENTS 3,855,700 12/1974 Gerson et al. ..... 30/169

FOREIGN PATENT DOCUMENTS 6920526 5/1969 Germany .

*Primary Examiner*—Alexander Thomas

*Attorney, Agent, or Firm*—Bachman & LaPointe, P.C.

[57] ABSTRACT

Filler spatula/plane made of plastic for removing material from surfaces that are to be repaired by means of a filler. The filler can be introduced as before using the filler spatula/plane, whereby at the same time, there remains enough space in the working device for a cleaning tool for the surface of the spatula and for a device that is suitable for removing the excess material in the intact area around the damaged site. The filler spatula/plane has ribs on the outside which are elevated out of the plane of the outside and run across the longitudinal edge with a spacing between them, and between the two insides of the broad sides, it has a removable tool for at least cleaning the ribs and the interspaces between the ribs. In addition, a nonwoven emery cloth can also be arranged between the two insides.

12 Claims, 1 Drawing Sheet

PLASTIC FILLER SPATULA/PLANE

BACKGROUND OF THE INVENTION

The present invention relates to a plastic filler spatula/plane for repairing damage in surfaces by means of a filler.

In repairing damage to surfaces, the filler is placed in a hole by means of a spatula. Then the excess material is removed. There is a plastic spatula for this purpose which forms the definition of the species and has a blade edge running obliquely from one longitudinal edge to the other. The excess filler is processed by means of this edge. In practice, however, it has been found that this known plastic spatula is difficult to handle by the person doing the job, especially when subsequently spreading the filler so it is even by means of a broad side.

SUMMARY OF THE INVENTION

Therefore, the object of the present invention is to propose an improved plastic spatula/plane.

This object is achieved according to the present invention by means of a plastic filler spatula/plane having the features described herein below.

Accordingly, the plastic filler spatula/plane has elevated ribs projecting above the plane of the outside and spaced a distance apart from one another, running across the longitudinal edge on the outside of at least one broad side. With the ribs arranged between them, these ribs form a plane surface with which the surface of the filler can be processed better. The plane surface can be provided on one or both sides of the plastic filler spatula/plane. Since the interspaces between the ribs and the top edges of the ribs become clogged with the filler, a removable tool for cleaning is also provided between the two insides of the broad sides. Since the plastic filler spatula/plane has a hollow space between the two opposite broad sides, this can be accommodate a tool matched to the shape of the ribs and their interspaces. This makes available to the user a plastic filler spatula/plane with improved handling and at the same time provides a tool for cleaning the plastic filler spatula/plane and integrated into it.

BRIEF DESCRIPTION OF THE DRAWINGS

This invention is explained in greater detail below on the basis of one embodiment in conjunction with the accompanying drawings, which show.

DETAILED DESCRIPTION OF PREFERRED EMBODIMENTS

According to a preferred embodiment, the ribs and the grooves forming interspaces between the ribs have a sinusoidal cross section. Furthermore, the tool is designed as a flat spatula and has a comb at one end, preferably with teeth that correspond to the ribs and their interspaces. The surface of the spatula can be cleaned easily with this comb.

To design the tool to be stable on the one hand and so that it can be handled well in the hand when spreading or planing and also so that the tool can be attached securely inside the plastic filler spatula/plane but still be easily removable, the plastic filler spatula/plane also has the following features, which are also important, especially from the standpoint of manufacturing the plastic filler spatula/plane and the tool as injection molded parts.

According to these preferred embodiments, the tool can be inserted into the hollow space by the end opposite the blade edge, and it has a handle on the end opposite the blade edge so that the handle covers the hollow space.

For the purpose of better handling, the broad sides have a first area wherein they are arranged essentially parallel to one another and wherein there are ribs and grooves, and they have a second area connected to the former, where they taper obliquely toward one another—on end forming the blade edge. Accordingly, the tool runs essentially parallel to one of the broad sides, and it also contains a nonwoven emery cloth in the area of the hollow space corresponding to the first area, to remove the excess material in the intact area around the damaged location.

The hollow space formed by the broad sides and narrow sides is advantageously closed all the way around, so that it forms an enclosure that is open on one side and is sealed by the handle of the tool inserted into it, where the handle forms a flush seal with the broad side and projects on the narrow side. The plastic filler spatula/plane therefore sits well in the hand and forms a stable, visually appealing unit.

The plastic filler spatula/plane according to the present invention has the advantage that the filler can still be inserted as before but then it can easily be leveled flush by anyone, and at the same time there is still room for a device for removing excess material in the intact area around the damage site and for cleaning the surface of the spatula.

Figure 1:
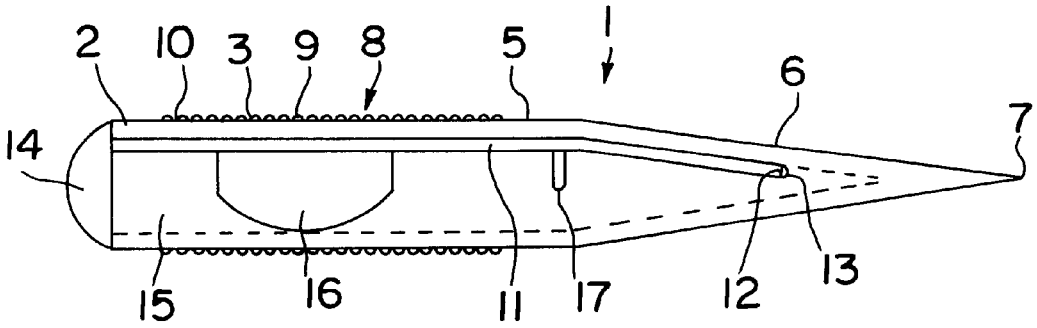
FIG. 1: a schematic cross section through the plastic filler spatula/plane with the tool inserted.
Figure 2:
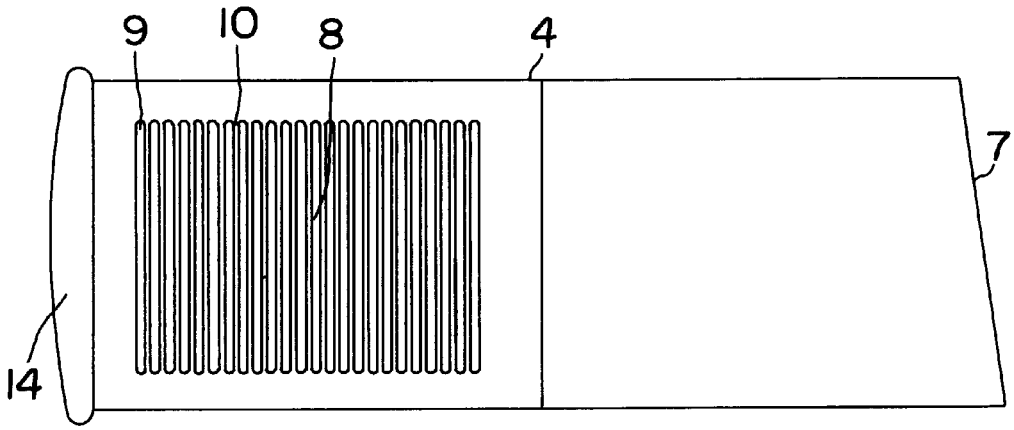
FIG. 2: a top view of the plastic filler spatula/plane according to FIG. 1.

Referring to the drawings, the plastic filler spatula/plane 1 shown schematically in cross section in FIG. 1 consists of a housing 2 which has two opposite broad sides 3 and two opposite narrow sides 4 (FIG. 2). The broad sides 3 consist of a parallel section 5 and a section 6 following that and tapering to a point. Sections 6 which taper to a point form a blade edge 7 at the end. As FIG. 2 shows, the blade edge 7 runs obliquely from one narrow side 4 to the other narrow side; A plane surface 8 composed of individual ribs 9 with grooves 10 running between them is provided on the two parallel areas 5. In this embodiment, the distance between ribs 9 is smaller than their width, and a sinusoidal pattern between ribs 9 and grooves 10 is the goal.

Inside the housing 2 there is a tool 11 in the form of a flat spatula with a cleaning edge 13 arranged on the end 12. Handle 14 is molded on tool 11 on the opposite end, sealing off the hollow space 15 between the two broad sides 3. As shown in FIG. 2, the handle 14 projects above the narrow side 4 so that it can be removed from the housing 2. With regard to the two broad sides 3, the handle forms a flush seal. Furthermore, a nonwoven emery cloth 16 which is applied to the tool 11 and can be removed from the tool 11 when the latter was removed from the housing 2, is in the hollow space 15. Part 17 serves to provide stability for the tool 11.

Figure 3:
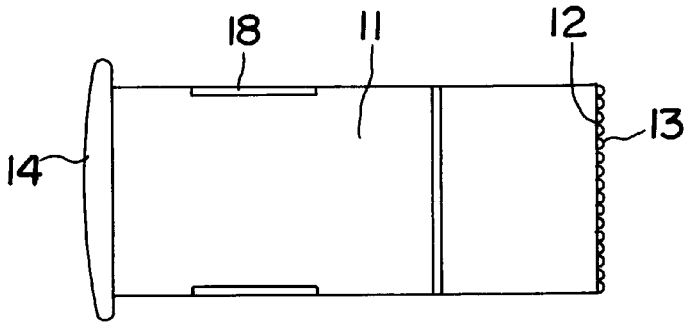
FIG. 3: a top view of the tool in the form of a cleaning comb.

The top view of the tool 11 according to FIG. 3 shows the cleaning comb 13 which extends over the entire width of the tool. The comb has the same teeth with spacings corresponding to those of plane surface 8. The nonwoven emery cloth shown in FIG. 1 is clamped on the tool between two holding parts 18.

All parts are manufactured as injection molded plastic parts, but tool 11 and housing 2 may have different colors. In addition, other parts may also be provided in the interior to increase stability.

Tool 11 can be secured on the housing 2 by means of suitable catch connections (not shown) or other means with which those skilled in the art are familiar, so that tool 11 is prevented from unintentionally falling out of the housing 2.

What is claimed is:

1. A plastic filler spatula/plane for repairing damage in surfaces by means of a filler, which comprises: two opposite broad sides and two opposite narrow sides, where the narrow sides taper toward one end; wherein the broad sides form a closed knife blade with a blade edge at said one end running obliquely from one longitudinal edge to the other, and the broad sides enclose a hollow space on the inside; at least one broad side having ribs on the outside thereof which are elevated out of the plane of the outside and run across the longitudinal edge with a spacing between them and form a plane surface for processing the filler; and a removable tool provided between the hollow space formed by the two insides of the broad and narrow sides for at least cleaning the ribs and the interspaces between the ribs, wherein the tool is designed as a flat spatula and can be inserted into the hollow space at the end opposite the closed blade edge.

2. A plastic filler spatula/plane according to claim 1, including grooves corresponding to the interspaces between the ribs, wherein the ribs and the grooves corresponding to the interspaces between the ribs are arranged above a limited area of the outside and form a plane surface.

3. A plastic filler spatula/plane according to claim 2, wherein the ribs and the grooves corresponding to the interspaces have a sinusoidal cross section.

4. A plastic filler spatula/plane according to claim 2, wherein the tool is designed as a flat spatula and it has a comb at one end thereof.

5. A plastic filler spatula/plane according to claim 4, wherein said comb includes teeth corresponding to the ribs and grooves.

6. A plastic filler spatula/plane according to claim 2, wherein the broad sides have a first area in which said broad sides are arranged essentially parallel to one another and in which the ribs and grooves are located, and wherein said broad sides have a second area which is connected to the first area and in which said broad sides taper toward one another obliquely at the end forming the knife edge.

7. A plastic filler spatula/plane according to claim 6, wherein said tool runs essentially parallel to one of the broad sides and also has a nonwoven emery cloth in the hollow area corresponding to the first area.

8. A plastic filler spatula/plane according to claim 1, wherein said tool can be inserted into the hollow space by the end opposite the blade edge.

9. A plastic filler spatula/plane according to claim 1, wherein said tool has a handle that covers the hollow space on the end opposite the blade edge.

10. A plastic filler spatula/plane according to claim 9, wherein the handle seals and is flush with the broad side.

11. A plastic filler spatula/plane according to claim 1, wherein said hollow space formed by the broad and narrow sides is designed so that it is closed all around.

12. A plastic filler spatula/plane according to claim 11, including a handle on the tool that covers the hollow space on the end opposite the blade edge, wherein the handle seals and is flush with the broad side.

* * * * *